US007287346B2

(12) United States Patent
Liu

(10) Patent No.: US 7,287,346 B2
(45) Date of Patent: Oct. 30, 2007

(54) ORNAMENTAL WATER BALL RENDERING CONTINUOUS ANIMATION VISUAL EFFECT

(76) Inventor: Jack Liu, 3F., 200, Xin-YI Rd., Sec. 3, Taipei (TW) 106

( * ) Notice: Subject to any disclaimer, the term of this patent is extended or adjusted under 35 U.S.C. 154(b) by 162 days.

(21) Appl. No.: 11/316,883

(22) Filed: Dec. 27, 2005

(65) Prior Publication Data

US 2007/0193083 A1 Aug. 23, 2007

(51) Int. Cl.
*B44F 1/02* (2006.01)

(52) U.S. Cl. ..... 40/427; 40/430; 40/409; 40/406

(58) Field of Classification Search ..... 40/406, 40/409, 410, 427, 430
See application file for complete search history.

(56) References Cited

U.S. PATENT DOCUMENTS 4,307,528 A * 12/1981 Dewees et al. ..... 40/433
5,272,604 A * 12/1993 Lin ..... 40/406
5,655,321 A * 8/1997 Chang ..... 40/409
6,508,022 B2 * 1/2003 Huang ..... 40/426
7,003,906 B1 * 2/2006 Yang ..... 40/430
2002/0152654 A1 * 10/2002 Liao ..... 40/406

* cited by examiner

*Primary Examiner*—Gary C. Hoge
(74) *Attorney, Agent, or Firm*—Lowe Hauptman Ham & Berner, LLP

(57) ABSTRACT

An ornamental water ball rendering continuous animation visual effect, including a reflection device having plural lenses, the reflection device is provided to an ornament support platform in the water ball; continuous animation adhesive stickers, in an amount equal to that of the lenses, applied to the water ball inner layer or outer layer at locations corresponding to where the reflection device is provided, whereby when the ornament support platform rotates simultaneously with the water ball, all of the adhesive stickers will be reflected by a corresponding lens so as to feature the water ball with continuous animation visual effect.

5 Claims, 2 Drawing Sheets

ORNAMENTAL WATER BALL RENDERING CONTINUOUS ANIMATION VISUAL EFFECT

CROSS-REFERENCES TO RELATED APPLICATIONS

Not Applicable

STATEMENT REGARDING FEDERALLY SPONSORED RESEARCH OR DEVELOPMENT

Not Applicable

DESCRIPTION

1. Field of Invention

This invention relates to an improved water ball structure, particularly to an ornamental water ball capable of rendering continuous animation visual effect.

2. Background

Conventional ornamental water balls (ornamental water balls) are constructed of the basic structure of a transparent water ball, in which is provided with theme models and decorative background such as tree, houses, castles or cartoon characters, in accompaniment with simulated snow flakes, to feature the water ball with dynamic viewing effect. The water ball base may alternatively be provided with a manual spring musical unit, to feature the water ball with visual as well as audio effect.

The emphasis for designing ornamental water balls in the industry mostly resides in the variety and attractiveness of the theme models, or the dynamic effect of the theme models within the water ball to earn the consumers' favor. The so-called dynamic landscape ornamental water balls (ornamental water balls with dynamic effect) refer to those having a variety of landscape models, which can be furnished on the tabletop or cupboard in a household or an office as an ornament object, wherein the landscape models may include tree, houses, castles or characters. To enhance the attractiveness of the landscape, the winding of a manual spring of a based musical unit to accumulate mechanical energy that is later released for driving rotation of the landscape models via a transmission mechanism may feature the water balls with rotating dynamic effect.

For example, the Chinese Model Patent No. 02238792.3 commonly assigned discloses a water ball provided therein with theme landscapes and filled with liquid. The base for supporting the water ball and liquid is provided therein with an agitating device, such as a transmission mechanism, for rotating and stirring the liquid and lighting with decorative effect. The mechanical energy accumulated by winding a manual spring is released to become power that is subsequently transmit upwards for driving rotation of the agitating device to continuously stir the water thereby causing paillettes distributed in the liquid to flow around the water ball along with the liquid, to generate a simulated dynamic landscape effect of snowing in accompaniment with a lighting background.

As "dynamic landscape ornaments" target at providing ornamental and playful effects, it is thus an object for the industry to enhance their dynamic effect so as to feature the visual landscape with improve attractiveness, for earning consumers' favor.

SUMMARY OF INVENTION

According to an aspect of this invention, an ornamental water ball rendering continuous animation visual effect is provided, where a reflection device comprising plural lenses is provided on an ornament support platform in the water ball, and continuous animation adhesive stickers, in an amount equal to that of the lenses, are applied to the water ball inner layer or outer layer at locations corresponding to where the reflection device is provided. As such, when the ornament support platform rotates simultaneously with the water ball, all of the adhesive stickers will be reflected by a corresponding lens so as to feature the water ball with continuous animation visual effect.

BRIEF DESCRIPTION OF THE DRAWINGS

These and other modifications and advantages will become even more apparent from the following detailed description of a preferred embodiment of the invention and from the drawings in which.

DETAILED DESCRIPTION OF THE INVENTION (PREFERRED EMBODIMENTS)

Figure 1:
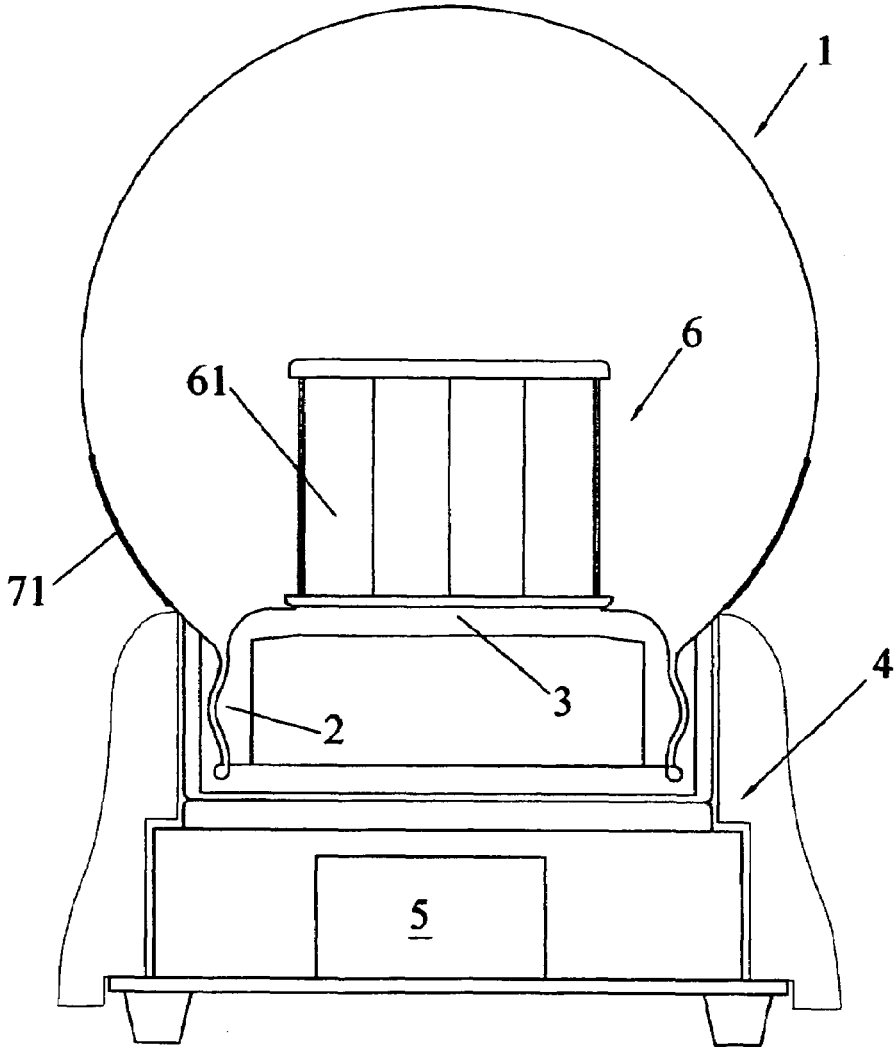
FIG. 1 illustrates a first embodiment of this invention.

With reference to FIG. 1, the first embodiment of this invention includes a water ball 1 filled with liquid, a rubber seal 2 for sealing the water ball 1, an ornament support platform 3 integrally formed with the rubber seal 2, a base 4 for supporting the water ball 1, and a conventional music unit or motor 5 and its transmission mechanism (not shown) concealed in the base 4.

In the prior art mentioned above, the prior water ball uses power provided by a conventional music unit or motor to drive simultaneous rotation of the water ball and ornamental models in the water ball by manes of a transmission mechanism. Similarly, the same form of power transmission may be implemented in this invention, where the power provided by the musical unit or motor 5 in the base 4 is used to drive simultaneous rotation of the water ball and the ornamental models in the ornamental models by means of the transmission mechanism. Since such form of power transmission has been widely implemented in the water ball manufactures, but not the characterized feature of this invention, it is not described in detail herein.

Figure 2:
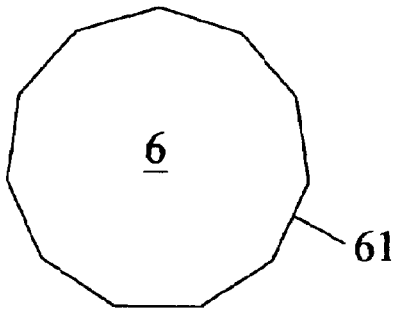
FIG. 2 illustrates a top plan view of the reflection device in the first embodiment of this invention.

As shown, the ornament support platform 3 of the water ball 1 is provided thereon with plural rectangular lenses 61 that are arranged in an order to form a reflection device 6 in the form of a polygonal frame (with reference to FIG. 2). Animation adhesive sticker 71, in an amount equal to that of the lenses 61, are then applied to a lower, peripheral inner layer or outer layer of the water ball 1 at locations to where the reflection device 6 is provided. As such, when the ornament support platform 3 rotates along with the water ball 1, all of the adhesive stickers 71 will be reflected by a corresponding rectangular lens 61 so as to feature the water ball with continuous animation visual effect.

Figure 4:
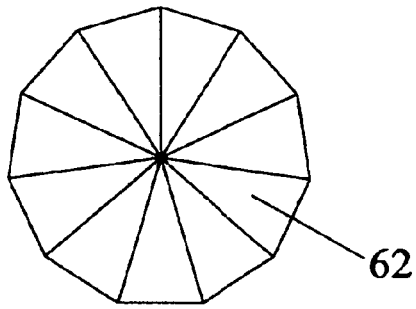
FIG. 4 illustrates a top plan view of the reflection device in the second embodiment of this invention.
Figure 3:
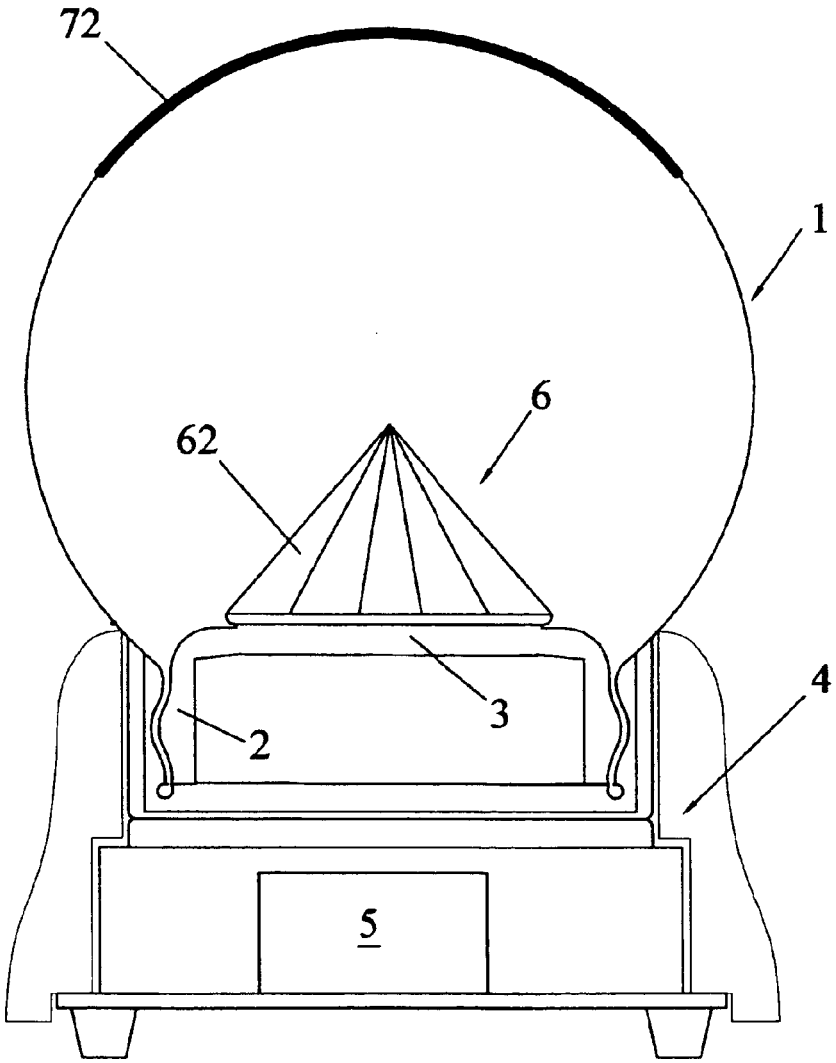
FIG. 3 illustrates a second embodiment of this invention.

Continuing to FIG. 3 and FIG. 4, a second embodiment of this invention also discloses a water ball 11 filled with liquid, a rubber seal 2 for sealing the water ball 1, an ornament support platform 3 integrally formed with the rubber seal 2, a base 4 for supporting the water ball 1, and a conventional music unit or motor 5 and its transmission mechanism (not shown) concealed in the base 4.

Different from the above first embodiment of this invention, the ornament support platform 3 of the water ball 1 is provided with plural triangular lenses 62 that are arranged in an order to form a reflection device 6 in the form of a pyramidal frame (with reference to FIG. 4). Animation adhesive sticker 72, in an amount equal to that of the lenses 62, are then applied to an upper, peripheral inner layer or outer layer of the water ball 1 at locations to where the reflection device 6 is provided. As such, when the ornament support platform 3 rotates along with the water ball 1, all of the adhesive stickers 72 will be reflected by a corresponding triangular lens 62 so as to feature the water ball with continuous animation visual effect.

In sum, through a simple structure, this invention provides a reflection device comprising plural lenses provided on an ornament support platform in the water ball, and continuous animation adhesive stickers, in an amount equal to that of the lenses, applied to the water ball inner layer or outer layer at locations corresponding to where the reflection device is provided. As such, when the ornament support platform rotates simultaneously with the water ball, all of the adhesive stickers will be reflected by a corresponding lens so as to feature the water ball with continuous animation visual effect.

This invention is related to a novel creation that makes a breakthrough in the art. Aforementioned explanations, however, are directed to the description of preferred embodiments according to this invention. Since this invention is not limited to the specific details described in connection with the preferred embodiments, changes and implementations to certain features of the preferred embodiments without altering the overall basic function of the invention are contemplated within the scope of the appended claims.

LIST OF REFERENCE NUMERALS

1 water ball
2 rubber seal
3 ornament support platform
4 base
5 conventional music unit or motor
6 reflection device
61 rectangular lenses
62 triangular lenses
71, 72 adhesive sticker

What is claimed is:

1. An ornamental water ball rendering continuous animation visual effect, comprising: a reflection device having plural lenses, the reflection device is provided to an ornament support platform in the water ball; continuous animation adhesive stickers, in an amount equal to that of the lenses, applied to the water ball inner layer or outer layer at locations corresponding to where the reflection device is provided, whereby when the ornament support platform rotates simultaneously with the water ball, all of the adhesive stickers will be reflected by a corresponding lens so as to feature the water ball with continuous animation visual effect.

2. The ornamental water ball rendering continuous animation visual effect of claim 1, wherein the lenses are rectangular lenses arranged in an order to form a polygonal frame.

3. The ornamental water ball rendering continuous animation visual effect of claim 1, wherein the lenses are triangular lenses arranged in an order to form a pyramidal frame.

4. The ornamental water ball rendering continuous animation visual effect of claim 1 or 2, wherein the continuous animation adhesive stickers, in the amount equal to that of the lenses, are applied to a lower peripheral inner layer or outer layer, at locations corresponding to where the lenses are provided.

5. The ornamental water ball rendering continuous animation visual effect of claim 1 or 3, wherein the continuous animation adhesive stickers, in the amount equal to that of the lenses, are applied to an upper peripheral inner layer or outer layer, at locations corresponding to where the lenses are provided.

* * * * *